US005456335A

United States Patent [19]

Kinsey

[11] Patent Number: 5,456,335

[45] Date of Patent: Oct. 10, 1995

[54] PATIENT LIFTING DEVICE

[76] Inventor: James E. Kinsey, 1051 Teresa Dr., Lake Park, Ga. 31636

[21] Appl. No.: 292,195

[22] Filed: Aug. 18, 1994

[51] Int. Cl.[6] ..... B66B 9/20

[52] U.S. Cl. ..... 187/240; 187/200; 414/921

[58] Field of Search ..... 187/200, 233, 187/244, 240, 267; 182/13, 14, 141; 414/921

[56] References Cited

U.S. PATENT DOCUMENTS

| | | | |
|---|---|---|---|
| 1,101,598 | 6/1914 | Weinke | 187/233 |
| 4,026,387 | 5/1977 | Abreu | 187/200 |
| 4,324,317 | 4/1982 | Winkelblech | 187/267 |
| 4,427,094 | 1/1984 | Winkelblech | 187/233 |
| 4,875,555 | 10/1989 | Johansson et al. | 187/9 R |

*Primary Examiner*—Kenneth Noland
*Attorney, Agent, or Firm*—Carnes, Cona, and Dixon

[57] ABSTRACT

The present invention provides for an easy to use lifting device that can be operable by a single attendant. In one of the embodiments, the lifting device is designed to enable the patient or a single attendant to activate and deactivate the lifting device. The lifting device also includes a shaft that is releasably secured to a base. Located on or within the shaft is a lifting mechanism. A seat frame having a seat attached thereto is secured to the lifting mechanism. An actuation device provides for the seat to be hoisted vertically along the shaft.

14 Claims, 5 Drawing Sheets

PATIENT LIFTING DEVICE

BACKGROUND OF THE INVENTION

The present invention relates generally to mechanical aids for lifting or lowering an incapacitated person or patient, and more particularly, to a lifting device that can be operated by the a single attendant.

DESCRIPTION OF THE PRIOR ART

It has long been recognized that there is a multiplicity of mechanical devices that will aid in the hoisting of a patient. Such a device is disclosed in, for example, U.S. Pat. No. 4,875,555 issued to Johansson et al. The lifting device in Johansson patent consists of an upper column part that is risible by the use of a motorized jack.

A problem with this mechanical device is that it is bulky, heavy, and made not to be disassembled. Thereby, making the device unsuitable for home use. Moving it from floor to floor would require disassembly on the initial floor, movement of the sub-assemblies, and reassemble for use on a lower or upper level. Where the patient is moved floor from floor in a home, for example, by means of stairs, the potential need for a lift device on each floor makes it necessary to own two or more mechanical lifts as disclosed in Johansson et al. Buying two or mechanical lifting devices is something which is generally unfeasible for most families of disabled or handicapped persons. For an institutional user, if an elevator is not available to transfer for any floor on which it has not been stationed, it becomes unavailable to for any floor on which it has not been stationed. Usually, an emergency requiring its use does not allow the time for its disassembly and reassembly. Institutions must buy a multitude of units of a device which may get only infrequent use.

What is needed is a lifting device that is especially configured and designed for home or institutional used. Ideally, this device should be capable of being disassembled, easy to use, long lasting, and inexpensive to manufacture.

SUMMARY OF THE INVENTION

This present invention provides for a device that will easily and efficiently permit for an incapacitated individual or patient to be lifted or lowered.

The device of the present invention includes an elongated shaft releasably secured to the top surface of a base. Optionally located on the bottom surface of the base is a plurality of wheels. These wheels will enable the device to be portable to render mobility from floor to floor within a dwelling, transportation between an automobile and a wheelchair, and bed to a lavatory.

A seat member travels vertically along the shaft and is located in the proximity of lifting mechanism. The location of the seat with respect to the lifting mechanism allows the patient or a single attendant to operate the device in order to articulate the patients exact placement.

The lifting device of the present invention can be made of a light weight and durable materials which provide for the device to be easily disassembled into very light subassemblies which can then be carried and re-assembled with ease at a different location, without difficulty, by one person, or stored trunk of an automobile for later use.

Accordingly, it is an object of the present invention to provide for a lifting device that will raise incapacitated individuals from a lower elevation to a higher one or visa versa.

Yet another object of the present invention is to provide for a lifting device that is simple in design and easy in utilization.

It is another object invention to provide a lifting device which will allow for an easy lateral transportation of the patient such as from wheelchairs to beds, car seats, or toilet seats.

A further object of the present invention to provide for the operation of the lifting device to be accomplished by the patient or another individual comfortably, effortlessly, and efficiently.

Still a further object of the present invention to provide for a lifting device that is simple in design and lightweight, yet of sufficiently durable construction to withstand prolonged and repeated bearings of heavy patient loads.

Still another object of the present invention is to provide for a lifting device that is will allow for its operation to be accomplished by a single attendant or in one embodiment by the patient himself.

Another object of the present invention is to provide for a lifting device that is inexpensive to fabricate and durable in operation.

Other objects, features, design and advantages of the present invention will become apparent to those skill in the art from the following detailed description. It should be understood, however, that the detailed description and specific example while indicating preferred embodiments of the present invention, are given by way of illustration and not limitation. Many changes and/or modifications within the scope of the present invention may be made without departing from the spirit thereof and the invention includes all such modification.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
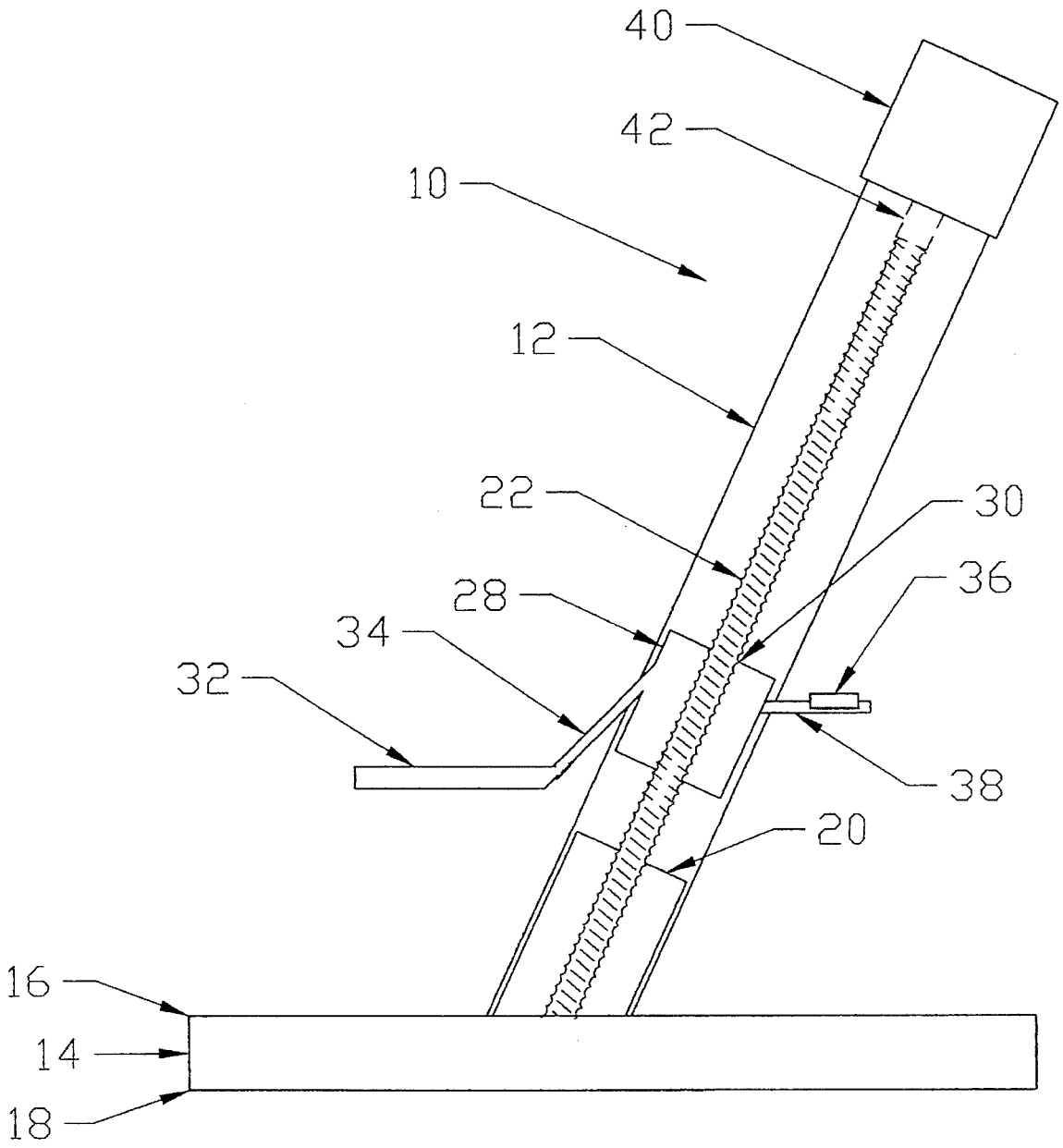
FIG. 1A is a partial cut-away view of the first embodiment of the lifting device of the present invention.
Figure 1B:
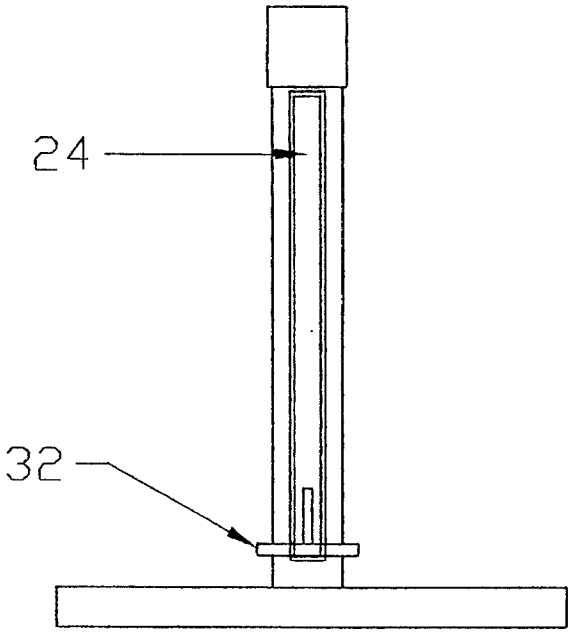
FIG. 1B is an elevational front view of the lifting device of the first embodiment of the present invention.
Figure 1C:
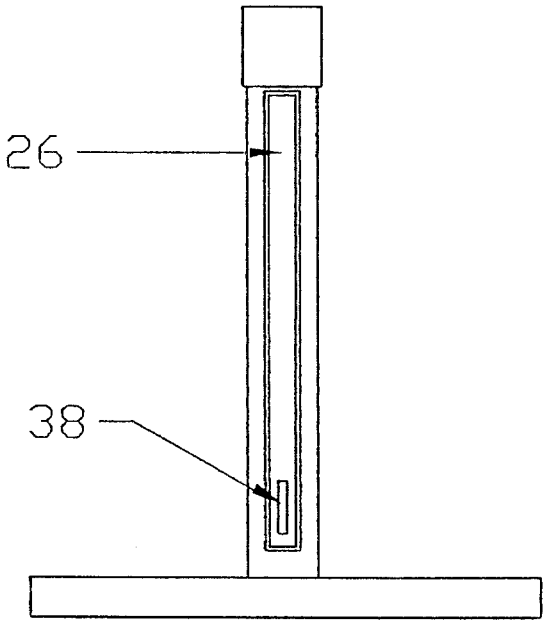
FIG. 1C is an elevational back view of the lifting device of the first embodiment of the present invention.

As illustrated in FIGS. 1A–1C, the patient lifting device 10 of the present invention consists of an elongated shaft 12 and a base 14. This shaft includes a first end, a middle portion, and a second end, while the base consists of a top surface 16 and a bottom surface 18, a front (not labeled) and a back (not labeled). Centrally located on the top surface of the base is a stud 20.

It is noted that the thickness of the base is exaggerated for illustrative purposes only.

The second end of the shaft is adapted to be removably secured to the base. This can be accomplished by two means. The first means is to provide for the stud 20 to be threaded. To enable releasable attachment to the stud, the second end of the shaft is internally threaded. This configuration provides for the shaft to be threadably secured to the top surface of the base.

The second means to removably secure the shaft to the base is not separately illustrated. This second means consists of providing for the stud to include an aperture. This aperture would extends horizontally through the shaft, causing the aperture to be parallel to the base. A first hole and a second hole would be located in the encompassing wall at the first end of shaft. These holes are located at opposite sides and are aligned with each other. In this arrangement, a cotter key or a pin would be inserted into or removed from the first hole, aperture, and second hole, respectively, in order to removably attach the second end of the shaft to the base.

The stud can be perpendicularly attached to the base (second embodiment) or the stud can also be attached to the base at an obtuse angle (first embodiment). In is noted that if the stud is attached at an obtuse angle then the back of the base would be increased to in length in order to allow for a patient's center of gravity to be within the range of the base. This will prevent the device from tipping.

The shaft 12 is a hollow body which houses the lifting mechanism. This shaft includes a first channel or groove 24. Located opposite the first channel or groove and in the shaft is a second channel or groove 26. These channels or grooves are vertically aligned on the shaft and extend along the middle portion of the shaft.

A reversible drive motor 40 having a shaft 42 is located on or within the first end of at the shaft. This reversible motor activates and deactivates the lifting mechanism.

A screw shaft 22, internally located in the middle portion of the shaft 12 is fastened to the motor 40 via its shaft 42. This screw shaft extends through the hollow region of the shaft.

A hollow cylinder 28 having a threaded through hole 30 is situated inside the shaft. The through hole 30 receives the screw shaft 22. This arrangement will permit for the hollow cylinder to travel vertically along the shaft by way of the screw shaft. A seat supporting means 34 is attach to the cylinder 28 and extends from the shaft via the first groove. This supporting means supports a seat 34. A handle 38 is attached to the cylinder and extends from the shaft via the second groove.

Attached to the handle is a first control panel 36. Electrical conduits (not illustrated) are attached from the control panel to the motor. This control panel includes a button for lifting and a button to lowering the seat. Each button will send the appropriate signal to motor the directional rotation of the shaft. These buttons are continuously depressed for upward and downward movement. If a stop is desired, then the respective button is released.

An optional second control panel (not illustrated) is located in the proximity of the motor. A second set of electrical conduits are attached from the second control panel to the motor. This configuration will enable a single attendant to operate the device via the second control panel while providing for opportunity for the patient to operate the device via the first control panel.

To utilize the first embodiment of the lifting device of the present invention, a patient is first placed on the seat. The device can then be initiated by the patient via the first control panel or another individual via the first or second control panels. Once activation has occurred (continuous depression of the upward or downward button), the control panel sends an activate signal through the electrical conduit to the reversible motor. The motor will be activated causing the shaft of the motor to initiate the rotation of the screw shaft. This will enable for the hollow cylinder to be raised or lowered (dependent on the signal sent). Inherently causing the seat to move vertically along the shaft. Once the desired height is obtain, the patient or the single attendant can deactivate the device by the control panel. In order to deactivate the system, the button is released, thereby causing a termination to the transportation of a signal to the motor. This will stop the rotational movement of the shaft. It is noted that the direction of rotation of the shaft is dependent upon whether the individual wishes to be lowered or raised.

It is noted that the supporting means of the seat can be designed so that it is threadably secured to the hollow cylinder. This will enable a simple means to disassemble the lifting device of the present invention into a plurality of subassemblies.

Figure 1D:
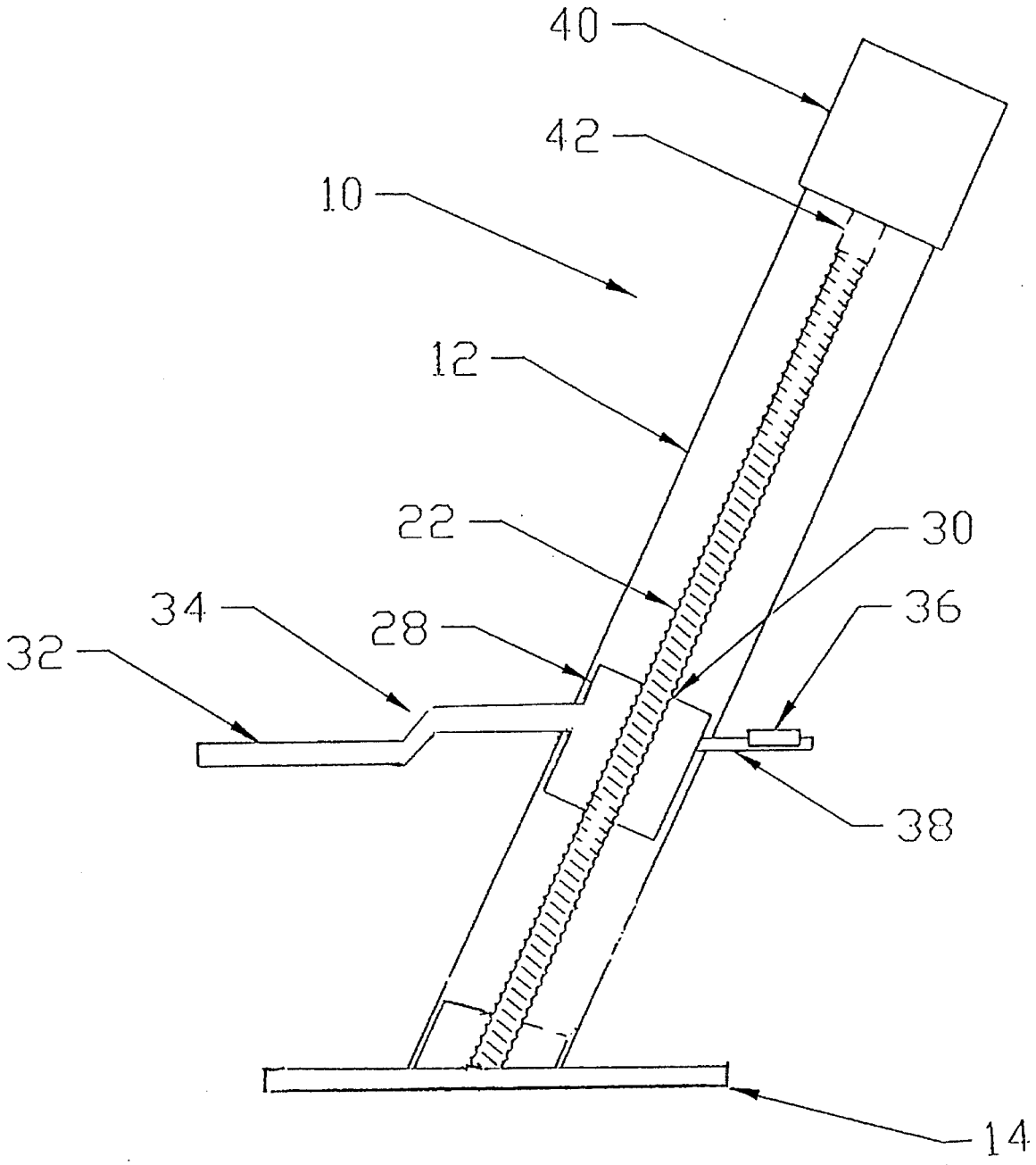
FIG. 1D is an elevational side view of the lifting device of the present invention having an altered seat supporting means.

The supporting means can also be designed as illustrated in FIG. 1D, so that a portion of the supporting means extends perpendicularly from the hollow cylinder. The perpendicular distance that this supporting means extends is equal to the length of the back portion of the base. The supporting means is then sloped slightly at a distance that is equal to the height of the base. Then the supporting means extends from the slop supporting means. This configuration will enable the supporting means of the seat to contact a floor, permitting a patient who might have fallen, an easy access to the lifting device.

The first embodiment of the present invention can also be altered to incorporate a turn handle. Though not separately illustrated, a turn handle may be attached on and extend through the motor. This turn handle would be secured to the shaft of the motor (inherently being attached to the screw shaft). This configuration will enable an individual to utilize the lift should the motor be inoperable.

Figure 2A:
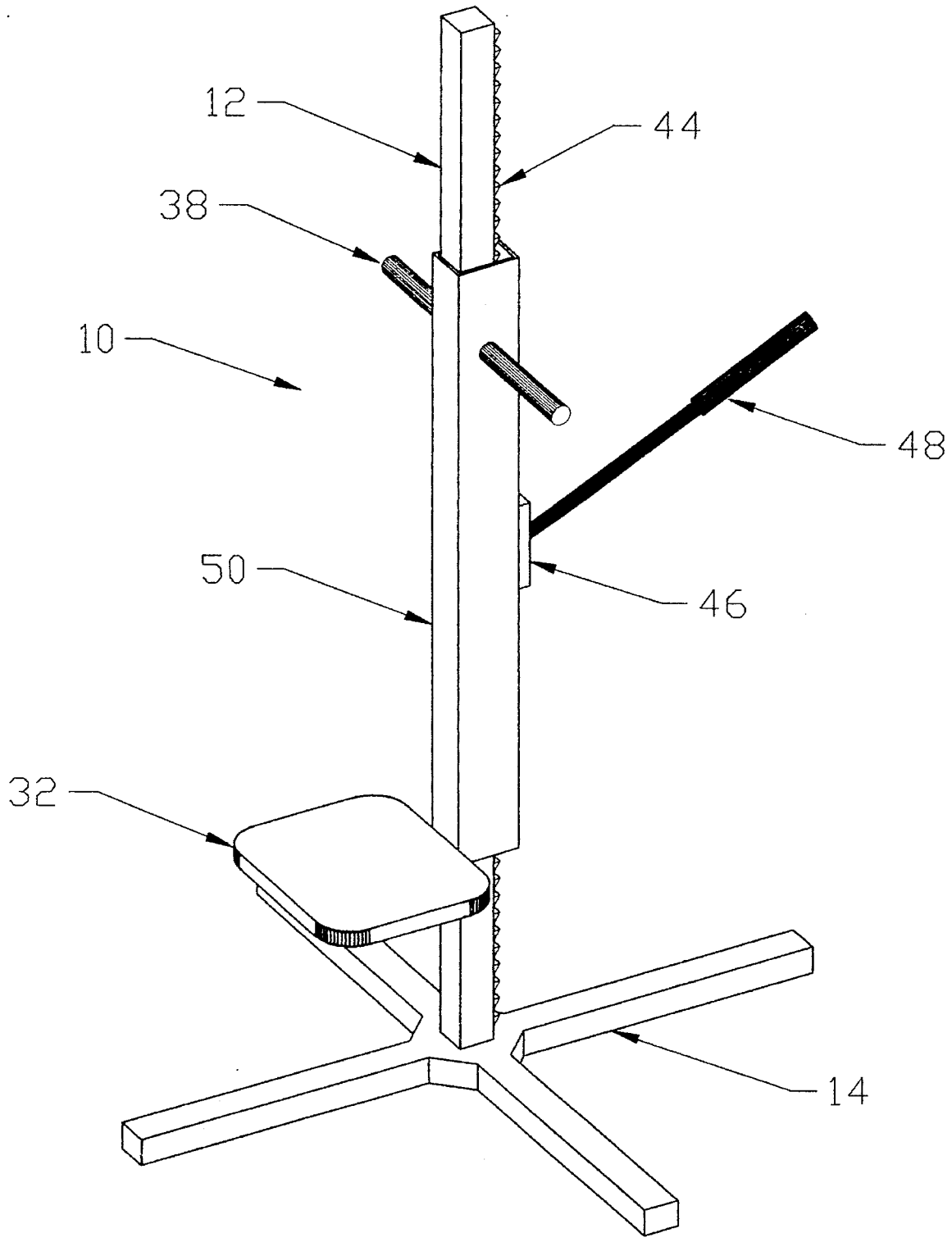
FIG. 2A is a perspective view of the second embodiment of the lifting device of the present invention.

In the above-describe embodiment, the lifting mechanism included the use of a motor, however, the lifting device of the present invention can also be arranged as illustrated in FIG. 2A, the second embodiment of the present invention, wherein a standard jacking device is employed for the lifting mechanism. As seen in this figure, the second embodiment of the lifting device 10 consists of a shaft 12 and a base 14. The shaft is adapted to be releasably secured to the top surface of the base. This is accomplished in the same manner as illustrated and discussed in FIGS. 1A–1C, the first embodiment of the present invention.

As seen in the second embodiment, one side of the shaft includes a plurality of teeth 44 vertically aligned. A standard jacking device 46 is located on the shaft 12. The standard jacking device 46 is protected and covered in a housing 50. This housing includes a first end, a second end, and a middle area. Attached to the first end of the housing 50 is the supporting means (not illustrated) of a seat 32. A manual jack having the handle 48 attached thereto is in communication with the teeth 44 of the shaft and is located in the middle of the housing.

The handle, from the manual jack, extends from the shaft via the manual jacking device and housing.

A second set of handles 38, extend from the second end of the housing 50 and are perpendicular to the jack handle 48. These handles provide for a hand grip for the user.

Figure 2B:
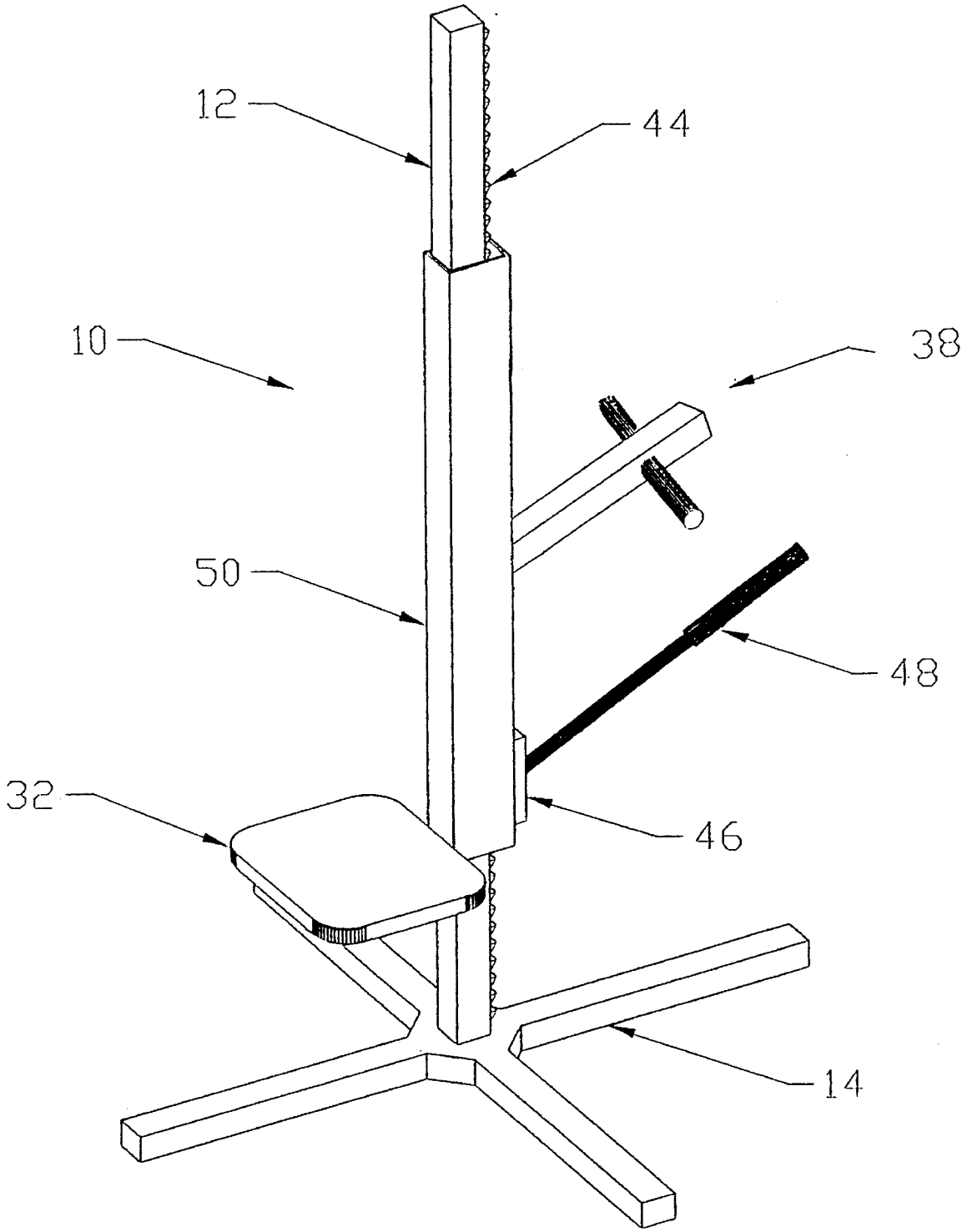
FIG. 2B is a perspective view of a slight alteration of the second embodiment of the lifting device of the present invention.

The location of the conventional jacking means and the location of the handles can be altered as illustrated in FIG. 2B. As seen in this embodiment, the jacking device 46 can be located in the first end of the housing, directly across from the seat 32. The second set of handles 38 can be located parallel to the jacking device and extend perpendicularly from the housing 50.

It is noted that the seat and seat supporting means as illustrated in FIGS. 2A and 2B can be changed as illustrated and discussed in FIG. 1D.

The utilization of this device employing the lifting means of the second embodiment is accomplished by first placing the patient on the seat. The handle is then push to allow for the lever of the handle to catch onto the teeth of the elongated rod. As it catches on the teeth, the standard jacking device and housing are moved vertically along with shaft and inherently the seat will moved vertically along the length of shaft 12.

The base which is used in the first and second embodiments can include a plurality of shapes. One of the shape can be rectangular (side view illustrated in FIG. 1A) or crossed (as illustrated in FIG. 2A). Though not separately illustrated, the base can be circular.

The lifting device of the present invention can also include a plurality of wheels to be located on the lower surface of the base. These wheels provide mobility of the device with or without the patient. Additionally, each of the wheels can be provided with a brake. These brakes permit stability of the device when desired.

While the invention has been particularly shown and described with reference to an embodiment thereof, it will be understood by those skilled in the art that various changes in form and detail may be made without departing from the spirit and scope of the invention.

I claim:

1. A lifting device comprising:

a shaft;

said shaft includes a first end, a middle portion, and a second end;

a base;

said base has an upper surface and a lower surface and said lower surface contacts a floor to permit for said lifting device to be a free standing article;

said second end of said shaft is adapted to be removably secured to said upper surface of said base by an attachment means;

a seat;

said seat includes an upper surface and a lower surface;

a lifting mechanism;

said seat is attached to said lifting mechanism;

an actuation means; and said actuation means provides for said seat to be hoisted along said shaft, and said lower surface of said seat contacts said floor, when said seat is in a lowered position for enabling a user to slide onto said seat and be in a sitting position and said seat is elevated to a desired level for said user, and wherein a clearance is located between said user when said user is in said sitting position and said actuation means.

2. A lifting device as in claim 1 wherein said attachment means includes a threaded stud;

said threaded stud is attached to said upper surface of said base;

said shaft is hollow;

said second end of said shaft is internally threaded.

3. A lifting device as in claim 2 wherein said threaded stud is perpendicular to said base.

4. A lifting device as in claim 2 wherein said threaded stud is attached to said base at an obtuse angle.

5. A lifting device as in claim 1 wherein said securing means includes a stud;

said stud is attached to said upper surface of said base;

an aperture is located horizontally in said stud and is parallel to said base;

said shaft is hollow and includes an encompassing side wall;

a first hole and a second hole are located in said encompassing side wall at said second end said first hole and said second hole extend into said opening;

said first hole is in a linear alignment with said second hole; and a cotter key or pin is removably insertable into said first hole, said aperture and said second hole.

6. A lifting device as in claim 5 wherein said stud is attached to said base at an obtuse angle.

7. A lifting device as in claim 5 wherein said stud is perpendicularly attached to said base.

8. A lifting device as in claim 1 wherein said lifting mechanism further includes a reversible drive motor that is located at said first end;

said reversible drive motor includes a second shaft;

said second shaft of said motor is internally located in said shaft at said first end;

a screw shaft has a first end and a second end;

said first end of said screw shaft is attached to said second shaft of said motor;

a first groove and a second groove;

said first groove and said second groove are located on said shaft;

a cylinder;

said cylinder includes a threaded through hole;

said cylinder is located in said shaft;

said threaded through hole receives said screw shaft;

a handle is attached to said cylinder;

said handle is attached to said cylinder and extends from said shaft via said second groove;

said seat includes a seat supporting means;

said seat supporting means is attached to said cylinder;

said supporting means extends from the shaft via said first groove;

a control panel;

said control panel is located on said handle;

a first set of electrical conduits is attached from said control panel to said reversible drive motor; and wherein said lifting device is activated by said control means to provide for an active signal to travel through said first set of electrical conduits to said reversible motor to cause said second shaft to rotate and initiate rotation of said screw shaft.

9. A lifting device as in claim 8 wherein a second control panel is located in the proximity of said reversible drive motor;

a second set of electrical conduits is attached from said second control panel to said reversible drive motor; and wherein said lifting device is activated by said control means or said second control means to enable said seat to be hoisted vertically on said shaft.

10. A lifting device as in claim 1 wherein said lifting means further includes a plurality of teeth;

said plurality of teeth is vertically located on said shaft;

a jacking device having a handle is located on said shaft;

said jacking device includes a first end, a middle, and a second end;

said jacking device is in communication with said plurality of teeth;

said jacking device is protected and covered by a housing;

said housing includes a first end, a second end, and a middle area;

said supporting means for said seat is attached to said first end of said housing;

a set of handles;

said set of handles is used for a hand grip;

said set of handles is attached to said shaft; and wherein said handle on said jacking device is pushed to provide for said jacking device to catch a tooth of said plurality of teeth to permit for said seat to move upward for each push that is made with said handle.

11. The lifting device as in claim 8 wherein said seat supporting means is adapted to be releasably secured to said cylinder.

12. The lifting device as in claim 1 wherein said bottom surface of said base further includes a plurality of wheels.

13. The lifting device as in claim 8 wherein said seat further includes a supporting means;

said supporting means attaches said seat to said cylinder; and said supporting means enables said seat to be aligned with said base when said cylinder contacts said stud.

14. The lifting device as in claim 10 wherein said seat further includes a supporting means;

said supporting means attaches said seat to said housing; and said supporting means enables said seat to be aligned with said base when said housing contacts said upper surface of said base.

* * * * *